US005385184A

United States Patent [19]

Mellor

[11] Patent Number: 5,385,184

[45] Date of Patent: Jan. 31, 1995

[54] VACUUM HOLDING DEVICE FOR A VENEER SLICER

[75] Inventor: David Mellor, Lockport, N.Y.

[73] Assignees: Merritt Plywood Machinery, Inc., Lockport, N.Y.; M. Böhlke Veneer Corp., Fairfield, Ohio

[21] Appl. No.: 182,748

[22] Filed: Jan. 18, 1994

[51] Int. Cl.[6] ..... B27L 5/06; B25B 11/00

[52] U.S. Cl. ..... 144/178; 144/162 R; 144/278 A; 248/362; 248/363; 269/21

[58] Field of Search ..... 248/362, 363; 51/235; 269/20, 21; 144/2 R, 162 R, 178, 278 A

[56] References Cited

U.S. PATENT DOCUMENTS

| | | | |
|---|---|---|---|
| 2,910,265 | 10/1950 | Anander | 248/363 |
| 3,307,817 | 3/1967 | Cocito | 248/362 |
| 3,905,408 | 9/1975 | Hale | 144/178 |
| 4,693,458 | 9/1987 | Lewecke et al. | 269/21 |

*Primary Examiner*—W. Donald Bray

*Attorney, Agent, or Firm*—Jaeckle, Fleischmann & Mugel

[57] ABSTRACT

A vacuum holding device is provided for a veneer slicer, comprising a vacuum source, a platen having a flat surface comprising a plurality of vacuum compartments, wherein each compartment contains at least one port connected through a vacuum line to the vacuum source, sealing means within each compartment, wherein the sealing means surrounds each compartment and also extends outwardly from the compartment beyond the flat surface of the platen such that a flitch to be sliced contacts the sealing means when the flitch is moved proximate the platen, wherein the compartment, sealing means and flitch create a vacuum chamber which holds the flitch in place during slicing; and, a ball valve connected in each vacuum line between each port and the vacuum source, wherein each ball valve is operatively arranged to open to create a vacuum to exist in its respective compartment.

18 Claims, 7 Drawing Sheets

11
11
146
103
148
101
111B
110
144
143
33
142
111A
141
132
102
134
140
103
104
131
136
101
174
135
133

VACUUM HOLDING DEVICE FOR A VENEER SLICER

BACKGROUND OF THE INVENTION

The present invention relates generally to an apparatus for slicing veneer, and, more particularly, to a vacuum holding device used to hold the material being sliced.

Veneer slicers are machines used for slicing thin wood veneer from pre-conditioned logs, commonly called "flitches". The logs are usually pre-conditioned by cutting them lengthwise in half and by soaking them in water. Presently, the flitch is conventionally held against a flat surface of the slicer by mechanical clamps, commonly called "dogs" and this entire assembly is moved in a vertically reciprocating motion. A sharp knife is then moved incrementally toward the flitch, eventually making contact to slice off thin sheets of veneer.

Using dogs to hold the flitch in place results in wasted material, since the thickness of the flitch between the flat holding surface and the top of the dog cannot be sliced by the knife. The remaining material, commonly called a "backing board" is often approximately 20 millimeters in thickness. It is readily apparent, then, that conventional dog clamping systems result in considerable waste of material.

Another problem caused by using dogs to hold the flitch in place is that the uneven pressure exerted by the dogs, coupled with the reduced strength of the flitch as material is cut away, can cause the flitch itself to bend or curl during the latter slicing stages. This results in an inferior product and wasted material.

The general concept of using a vacuum to hold the flitch in place is known, although not heretofore accomplished successfully in practice. U.S. Pat. No. 4,693,458 (Leweche et al.), for example, discloses a clamping arrangement for lumber elements, which elements are held in place by a vacuum. Upon information and belief, this device, used for sawing wood as opposed to slicing veneer, would not function satisfactorily in a veneer slicing operation (and may not function satisfactorily even in a typical wood sawing operation.) The reason is that, in veneer processing, the wood is preconditioned by soaking in water, which results in a large amount of wood debris and wood resin from the saturated flitch. This contaminate material is sucked up by the vacuum and quickly plugs up the orifices, valves, and pumps used in the system. The vacuum is eventually lost, and the flitch can no longer be held to the holding surface.

Thus, a longfelt need has existed for a vacuum holding device for a veneer slicer, which device is capable of sucking wood debris and resins without losing vacuum.

BRIEF SUMMARY OF THE INVENTION

The present invention is a vacuum holding device for a veneer slicer, comprising a vacuum source, a platen having a flat surface comprising a plurality of vacuum compartments, wherein each compartment contains at least one port connected through a vacuum line to the vacuum source, sealing means within each compartment, wherein the sealing means surrounds each compartment and also extends outwardly from the compartment beyond the flat surface of the platen such that a flitch to be sliced contacts the sealing means when the flitch is moved proximate the platen, wherein the compartment, sealing means and flitch create a vacuum chamber which holds the flitch in place during slicing; and, a ball valve connected in each vacuum line between each port and the vacuum source, wherein each ball valve is operatively arranged to open to create a vacuum to exist in its respective compartment. In a preferred embodiment, the compartment is divided into subcompartments, each selectively capable of establishing a vacuum. Vacuum is established in only those subcompartments which are covered by a flitch, which accommodates the holding of various size flitches.

Accordingly, an overall object of the invention is to hold a flitch to a slicing device with a vacuum and without the use of dog clamps so that more of the flitch may be sliced, thereby increasing yield and reducing waste.

A secondary object of the invention is to hold a flitch to a slicing device with more evenly applied pressure to eliminate the tendency a flitch has to curl or warp when held by dog clamps as the slicer gets closer to the dogs.

DETAILED DESCRIPTION OF THE INVENTION

Figure 1:
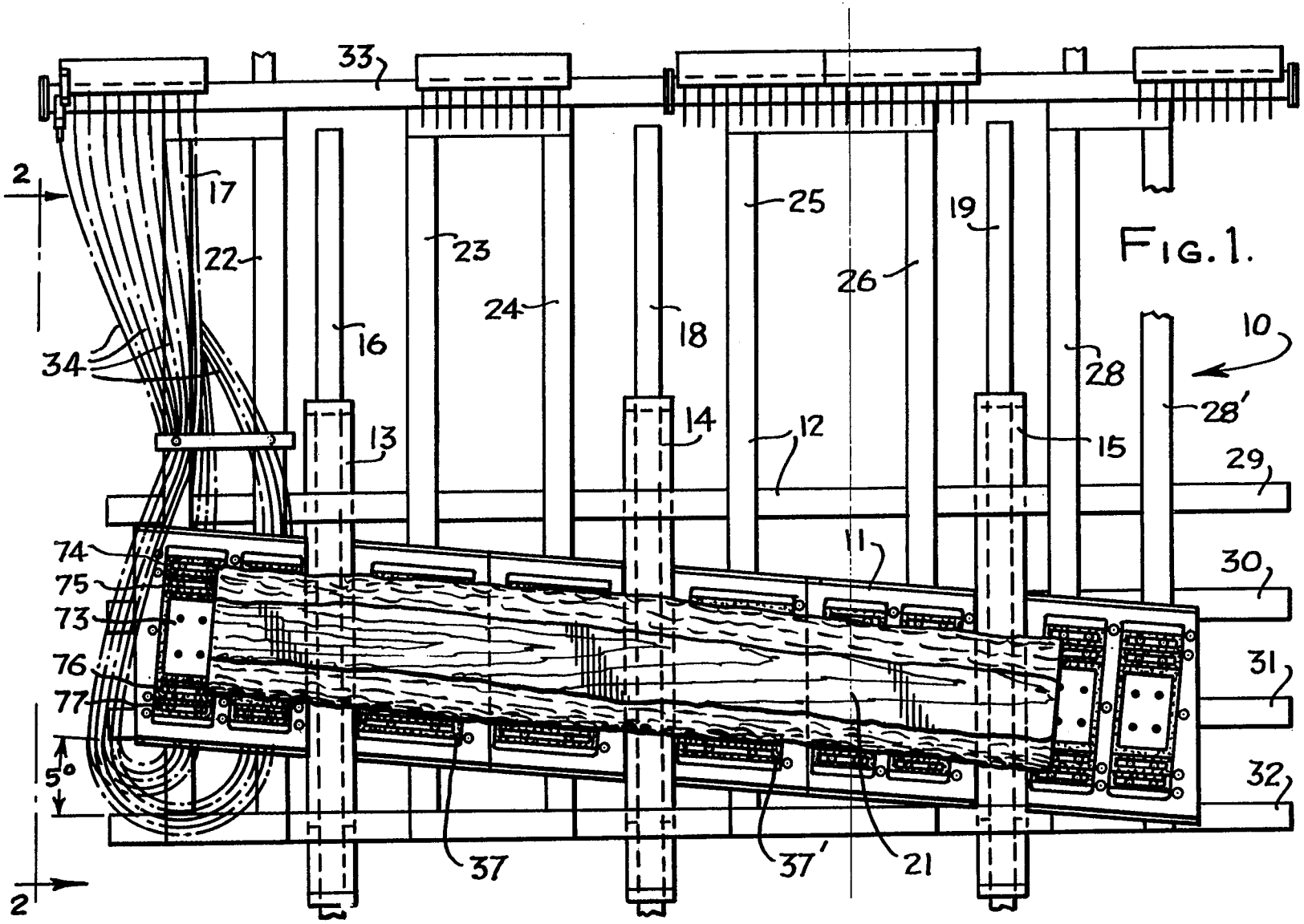
FIG. 1 is a simplified front elevation of the apparatus of the invention.

At the outset, it should be clearly understood that like reference numerals are intended to identify the same structural elements, portions or surfaces consistently throughout the several drawing figures, as such elements, portions or surfaces may be further described or explained by the entire written specification. Unless otherwise indicated, the drawings are intended to be read together with the specification, and are to be considered a portion of the entire "written description" of this invention. The terms "top", "bottom", "left", "right", "front", "back", "up", "down", "side", "vertical", "horizontal", and derivatives thereof refer to the perspective of a viewer of FIG. 1.

FIG. 1 is a simplified front elevation of the vacuum holding device 10. The device broadly comprises flitch table 12, which is a lattice-like frame operatively arranged for reciprocating movement up and down from a perspective viewing FIG. 1. The purpose of the flitch table is to hold and move the flitch up and down during the slicing operation. It is to be understood, however, that, in some embodiments, the flitch table can remain stationary while the slicing knife moves.

The flitch table is comprised of vertical support members 17, 22, 23, 24, 25, 26, 28 and 28' and horizontal support members 29, 30, 31 and 32 which are fixedly secured to one another in a lattice form by any suitable means, such as weldments, nuts and bolts, etc. Mounted at the top of the lattice frame is vacuum manifold 33, which is a hollow member whose function is described in more detail infra.

In the embodiment shown in FIG. 1, the flitch table 12 reciprocates vertically while the slicing knife 36 (shown in FIG. 2) is stationary in the vertical plane but moves horizontally toward and away from the table. It should be noted that the invention would function equally well in an embodiment where the flitch table is stationary in the horizontal plane and the knife reciprocates.

Mounted to flitch table 12 is vacuum pad platen 11. The vacuum pad platen has a flat surface 52 (shown in FIG. 2) and comprises a plurality of vacuum compartments, described in more detail infra. Two typical compartments 37 and 37' are labeled in FIG. 1, which illustrates nine separate compartments. Each compartment in FIG. 1 is further divided into subcompartments, to accommodate flitches of different sizes, although the device could function with undivided compartments so long as the flitch was large enough (widthwise) to completely cover one or more compartments.

Each subcompartment contains at least one port connected through a vacuum line to a source of vacuum. Each subcompartment also includes sealing means which surrounds each subcompartment and also extends outwardly from the subcompartment beyond the flat surface of the platen such that a flitch 21 to be sliced contacts the sealing means when the flitch is moved proximate the platen. Each subcompartment, sealing means and flitch create a vacuum chamber which holds the flitch in place during slicing, as illustrated in FIG. 1.

As shown in FIG. 1, the vacuum pad platen 11 is mounted to the lattice frame at approximately a 5° angle as measured from the horizontal. This is typical in the veneer slicing industry, and is done to reduce the force exerted on the cutting blade during slicing. Obviously a tremendous force would be exerted on the knife if the platen was mounted at a 0° angle (i.e., horizontal).

Also shown in FIG. 1 is a plurality of vacuum lines 34 extending to the subcompartments of the leftmost two vacuum compartments. For simplicity, the vacuum lines connected to the remaining subcompartments are not shown on the drawing.

Figure 2:
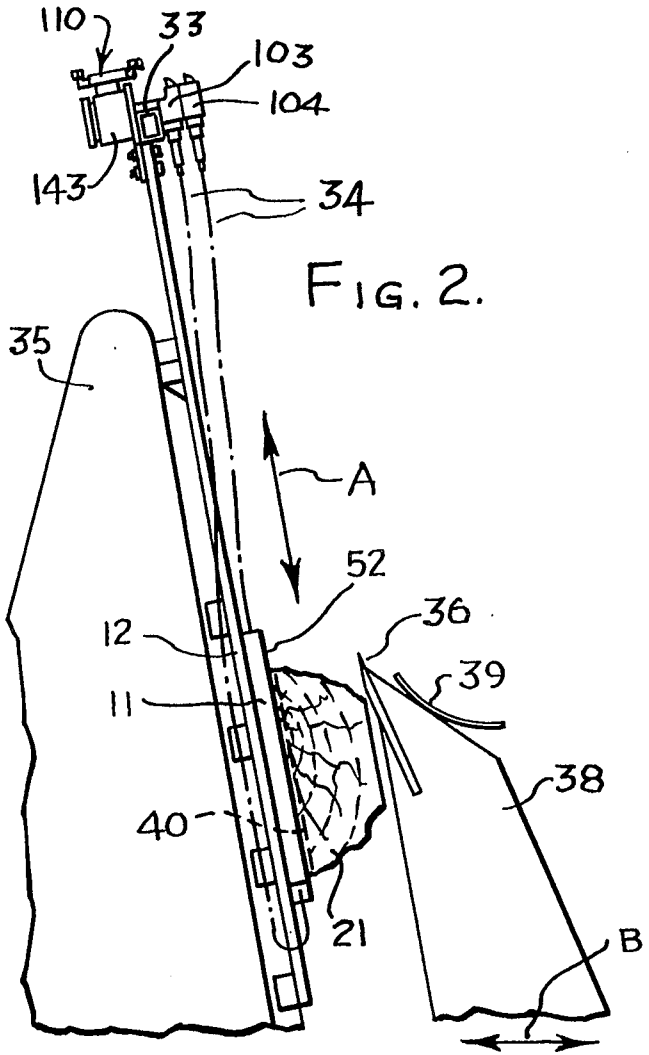
FIG. 2 is a partial side elevation of the apparatus, taken generally along lines 2—2 of FIG. 1, illustrating how a flitch is held in place during slicing.

FIG. 2 is a partial side elevation of the holding device, taken generally along lines 2—2 of FIG. 1, illustrating how flitch 21 is held in place during slicing. Flitch 12 moves in a vertically reciprocating manner with respect to foundation 35, as illustrated by movement double arrow A. Also shown in FIG. 2 is knife carriage 38 which is operatively arranged to move toward and away from flitch 21 as illustrated by direction arrow B. Knife 36 is mounted to carriage 38. As the flitch moves in a downward direction veneer slices 39 are cut from the flitch. (Not shown in FIG. 2 is a nose bar located above and proximate the knife which functions to maintain the thickness and quality of the sliced veneer sheets.) Dotted line 40 illustrates how closely the veneer may be sliced relative to the platen.

FIG. 2 also illustrates the flat surface 52 of the platen. As will be described in more detail infra, when the vacuum is established, the flitch is drawn into contact with surface 52.

Figure 3:
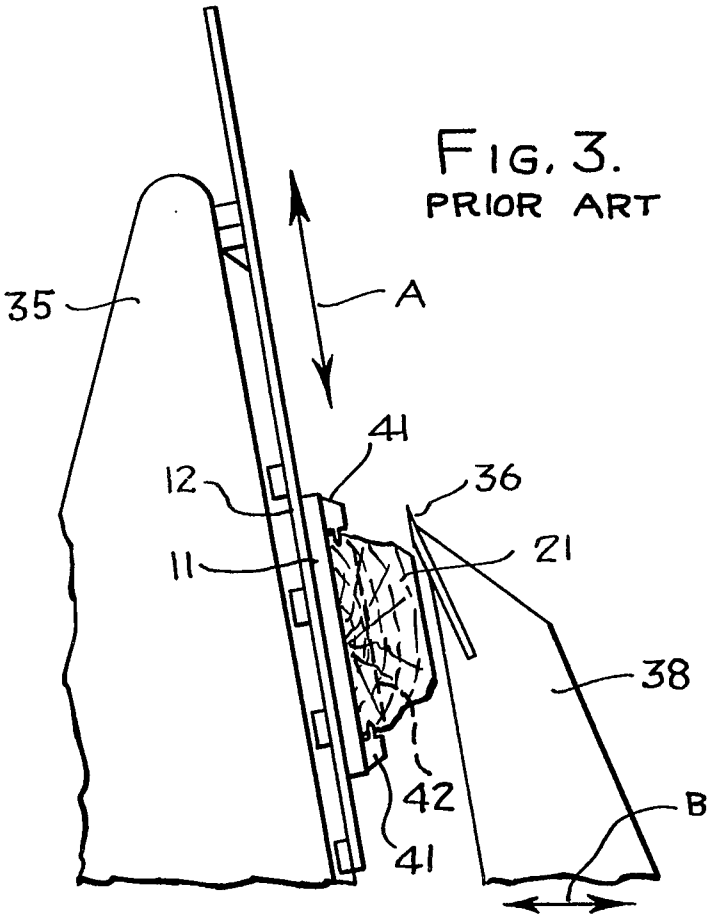
FIG. 3. PRIOR ART
FIG. 3 is a view similar to that of FIG. 2, except illustrating a typical prior art device which uses dogs to hold the flitch in place.

FIG. 3 is a view similar to FIG. 2, except illustrating a prior art device which uses dogs 41 to hold the flitch to the platen. Dotted line 42 illustrates how closely the veneer may be sliced relative to the platen. Obviously, the knife cannot be brought as closely to the platen as with the present invention, which results in a much thicker backboard (the material remaining after cutting) which is wasted. In a preferred embodiment the knife may be brought so close to the platen as to leave a 7 mm thick backboard, as opposed to 20 mm thick backboards which are typical in prior art devices.

Figure 4:
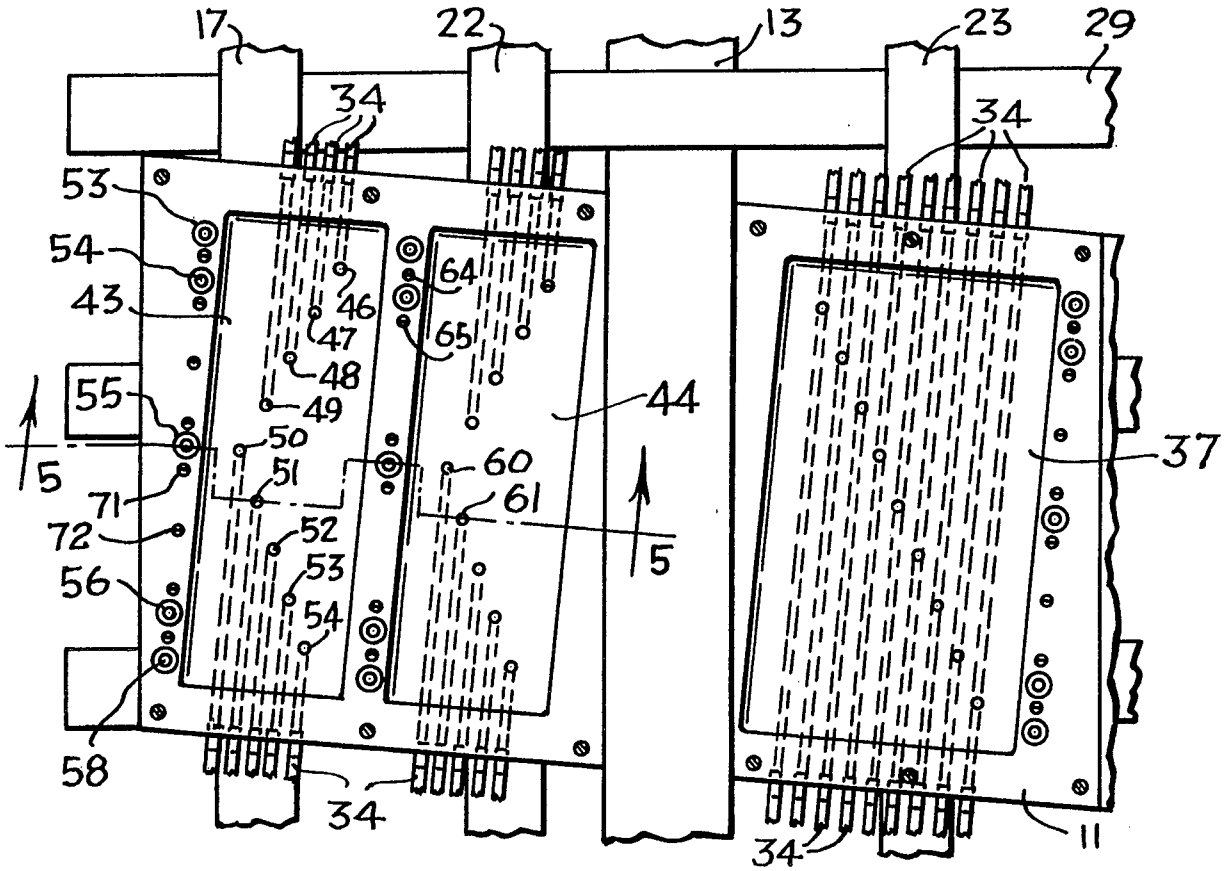
FIG. 4 is an enlarged fragmentary view of the vacuum pad platen.
Figure 5:
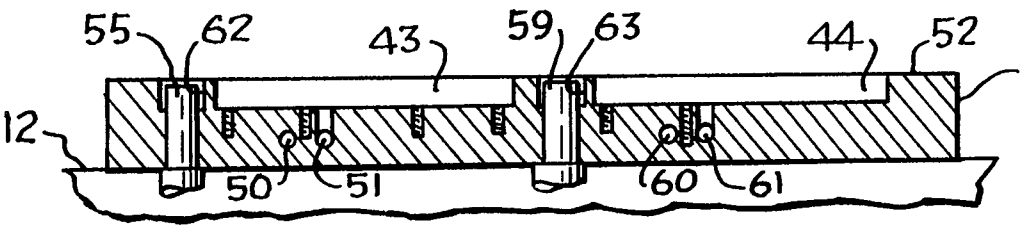
FIG. 5 is an enlarged cross-sectional view taken generally along line 5—5 in FIG. 4.

FIG. 4 is an enlarged fragmentary view of the vacuum pad platen 11, and FIG. 5 therebelow is an enlarged cross-sectional view taken generally along line 5—5 in FIG. 4. Platen 11 contains a plurality of vacuum compartments arranged horizontally adjacent one another. Three compartments 43, 44, and 37 are shown in FIG. 4, whereas compartments 43 and 44 are shown in cross-section in FIG. 5. The exact size and shape of the vacuum compartments is not critical. From an engineering and energy efficiency standpoint, however, it makes more sense to make the compartments wider in the center of the platen and narrower on the ends. The flitch is typically placed at one end (e.g., right end viewing FIG. 4) of the platen, and flitches of various lengths may be held in place. Referring to FIG. 4, a short flitch may cover compartment 37 but not compartments 43 and 44. A slightly longer flitch may extend leftwardly to cover compartment 44, and a still longer flitch will extend leftwardly to cover compartment 43. Since a vacuum is created in only those compartments which are covered, energy is saved by arranging narrower compartments on the ends of the platen.

Each compartment contains one or more ports which link the compartment to a source of vacuum. Compartment 43 is shown as containing eight ports 46–54. The ports are created by bores in the platen, illustrated by dotted lines in FIG. 4.

As stated earlier, a vacuum is established in only those compartments which are covered. Sensing means are used to sense when a compartment is completely covered, and to trigger a valve to open to establish a vacuum in the covered compartment. Referring to FIG. 4, sensors 53, 54, 55, 56 and 58 are associated with compartment 43. Corresponding sensors are shown for compartments 44 and 37. At least one sensor is needed for each compartment. A plurality of sensors is shown because each compartment may be subdivided into subcompartments, and each subcompartment requires its own sensor. In a preferred embodiment, the sensor is a photoelectric eye (Telemecanique Model XUB-H083135 12/24 Volts, or equivalent.)

FIG. 5 illustrates in cross-section compartments 43 and 44. Also shown is sensor 55 associated with compartment 43 and sensor 59 associated with compartment 44. Sensor 55 is recessed and mounted in bore 62 whereas sensor 59 is recessed and mounted in bore 63. All remaining sensors are similarly mounted. Note that the sensors are located to the left of their respective compartments. The sensors are thus offset from their respective compartments. If a flitch extends leftwardly from the center of the platen, the flitch must cover sensor 59 in order for a vacuum to be established in compartment 44, and must cover sensor 55 in order for a vacuum to be established in compartment 43.

Shown in FIG. 4 are a plurality of spikes of which representative spikes 64 and 65 are labeled. In a preferred embodiment there may be as many as 54 or more spikes mounted in the platen. The spikes extend above the surface of the platen and function to further hold the flitch in place when a vacuum is established.

Figure 7:
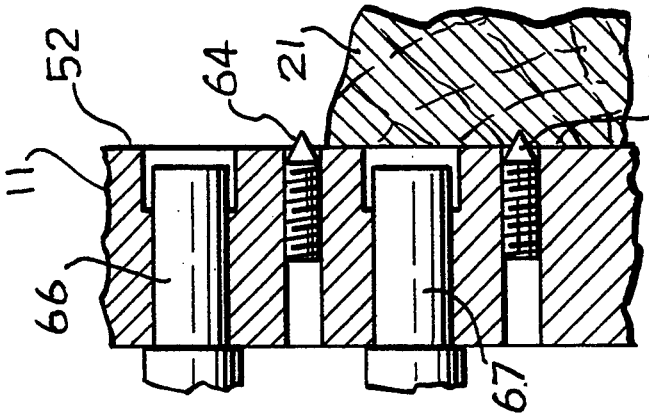
FIG. 7 is a fragmentary cross sectional view taken generally along line 7—7 of FIG. 6.
Figure 6:
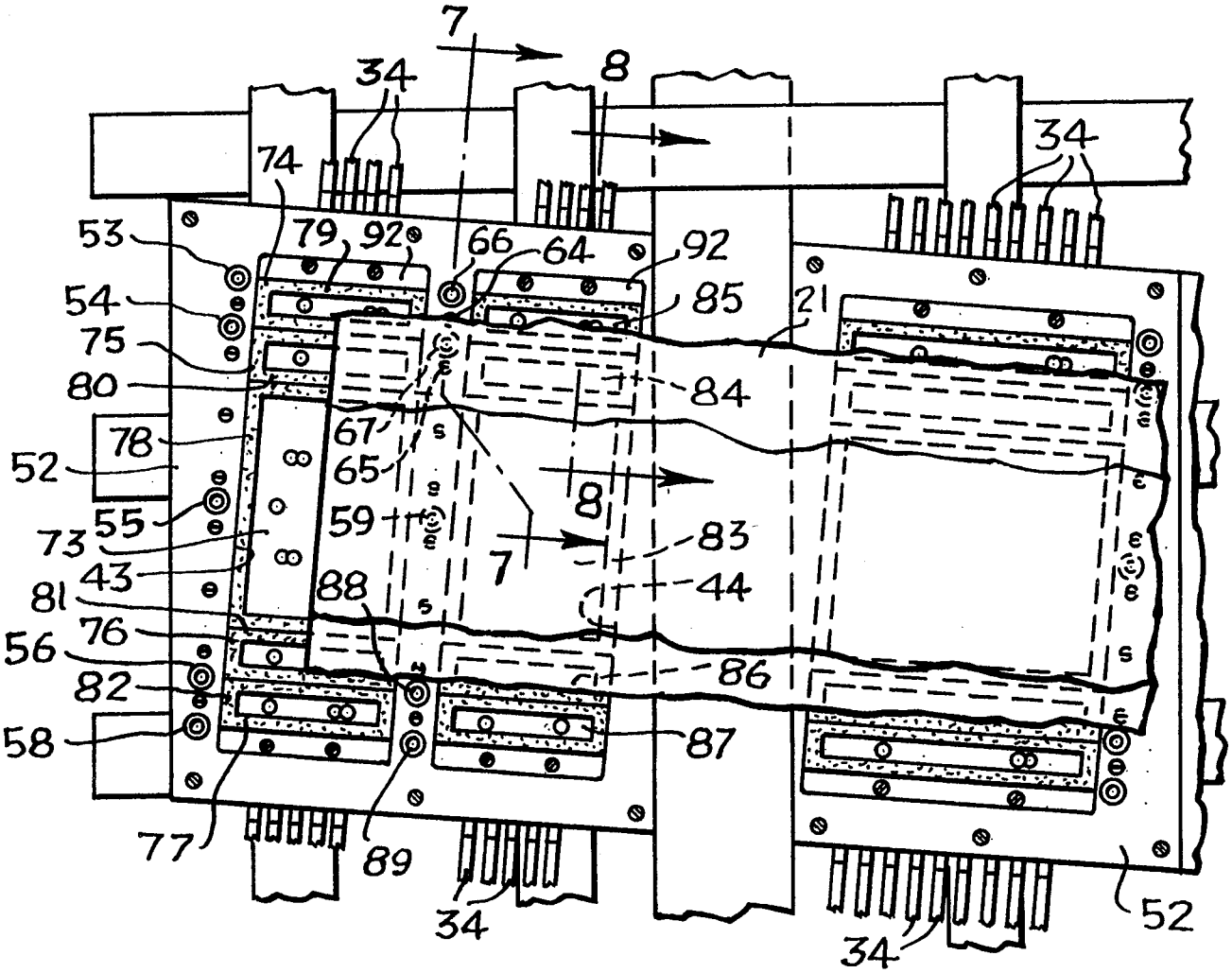
FIG. 6 is a view similar to that of FIG. 4, except with a flitch being held in place against the vacuum pad platen.

FIGS. 6 and 7 illustrate two important aspects of the invention. First, FIG. 6 illustrates how the main vacuum compartments may be divided into subcompartments. Secondly, both figures illustrate the function of the spikes and photoelectric eyes when a flitch covers the platen.

Each compartment may be divided into subcompartments. As shown in FIG. 6, compartment 43 has been divided into five subcompartments, including central subcompartment 73, upper subcompartment 75, far upper subcompartment 74, lower subcompartment 76, and far lower subcompartment 77. Sealing means 79 surrounds and forms subcompartment 74; sealing means 80 surrounds and forms subcompartment 75; sealing means 78 surrounds and forms subcompartment 73; sealing means 81 surrounds and forms subcompartment 77; and sealing means 82 surrounds and forms subcompartment 77. In a preferred embodiment, each sealing means is comprised of a closed cell rubber which extends above the surface 52 of platen 11. The seal may have various cross-sectional shapes and may be a continuous loop or be made in discrete sections.

As shown in FIG. 6, flitch 21 only partially covers the subcompartments of compartment 43, and does not cover any of sensors 53, 54, 55, 56, or 58. Hence, a vacuum would not be established in any of the subcompartments of compartment 43. To the right of compartment 43 is compartment 44, which includes subcompartments 83, 84, 85, 86 and 87. Note that subcompartments 83 and 84 are completely covered by the flitch, as are their respective sensors 59 and 67. Hence a vacuum would be established in subcompartments 83 and 84. The flitch completely covers subcompartment 86 but does not cover its sensor 88. Hence, a vacuum would not be created in subcompartment 86. Subcompartments 85 and 87 are not covered, nor are their sensors 66 and 89. Hence, a vacuum would not be established in subcompartments 85 and 87.

FIG. 6 illustrates how the compartments are arranged horizontally adjacent one another, and how the flitch extends longitudinally across the platen and its compartments. The figure also illustrates how the subcompartments are arranged vertically adjacent one another and the flitch extends widthwise across the platen and its subcompartments.

FIG. 6 also illustrates how the sensors are offset from their respective subcompartments. For example, sensor 66 is located to the upper left of subcompartment 85. Hence, when the flitch is positioned longitudinally on the platen, it must be both long enough and wide enough to cover sensor 66 in order for a vacuum to be established in subcompartment 85. This positioning scheme of the sensors relative to their subcompartments assures that the device will not attempt to establish a vacuum in any uncovered subcompartment.

FIG. 7 illustrates how sensor 68 is covered and sensor 66 is not. It also illustrates how spikes 64 and 65 extend outwardly from surface 52 of platen 11. The spikes are threaded into bores in the platen. In a preferred embodiment, chiselshaped tips are used and the edges of the tips are aligned horizontally with respect to the platen, in order that they align with the grain of the flitch being held. (Other shaped tips could also be used.)

In FIG. 7, a vacuum has been established which draws the flitch into contact with the surface of the platen. The vacuum is so strong that it causes the spikes (e.g., spike 65) to penetrate the wood. The spikes function to further hold the flitch to the platen, especially during slicing.

Figure 8:
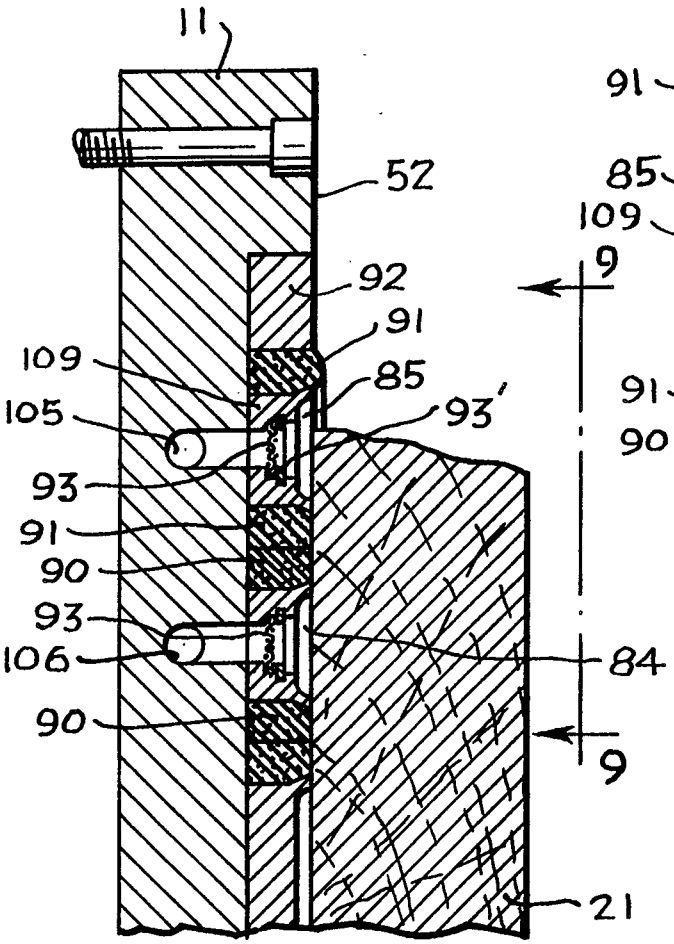
FIG. 8 is a fragmentary cross sectional view taken generally along line 8—8 of FIG. 6.

FIG. 8 is a fragmentary cross sectional view taken generally along line 8—8 of FIG. 6, and illustrates a section of compartment 44. A filler bar 92 is located in the top of the compartment. Seal 91 is held between the filler bar and and foundation 109 of subcompartment 85. Foundation 109 contains a cavity which forms subcompartment 85. The foundation also contain a throughbore which forms vacuum port 105. Between subcompartment 85 and port 105 is filter screen 93 which traps certain contaminate materials when the vacuum is energized. Seal 91 completely surrounds foundation 109. Seal 90 completely surrounds foundation 108 which forms subcompartment 84. Filter screen 93 is interposed between subcompartment 84 and port 106.

As shown in FIG. 8, which illustrates the invention with the vacuum energized, flitch 21 completely covers subcompartment 84, compressing seal 90 such that the flitch contacts surface 52 of platen 11. The flitch does not completely cover subcompartment 85, and the upper portion of seal 91 is shown uncompressed and extending above surface 11.

Figure 9:
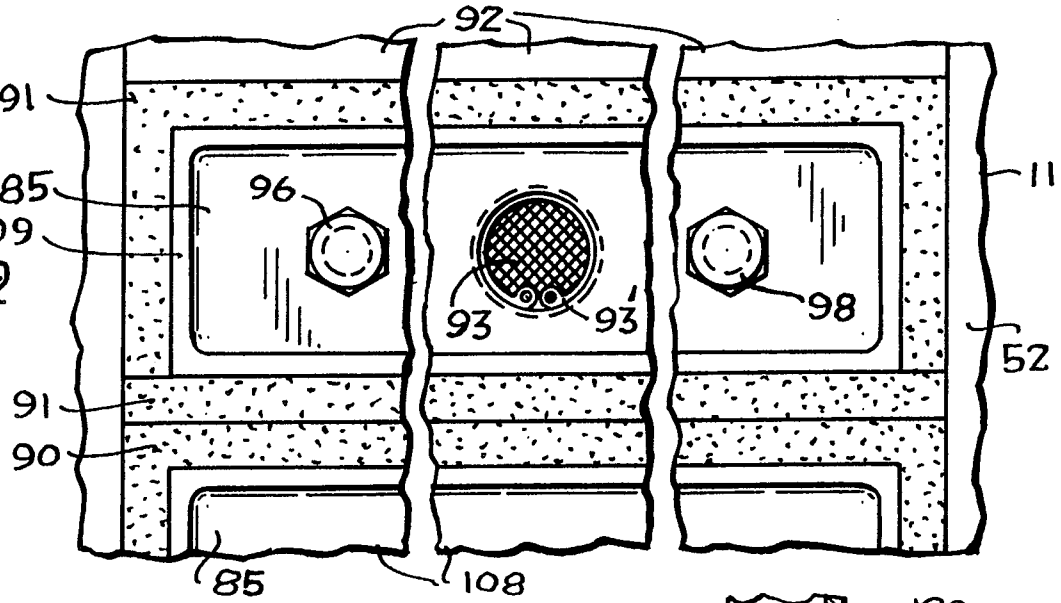
FIG. 9 is a view taken generally along line 9—9 of FIG. 8 except with the flitch removed.

FIG. 9 is a view taken generally along line 9—9 of FIG. 8 except with the flitch removed. Foundation 109 is shown mounted to platen 11 by bolts 96 and 98. Also, filter screen 93 can be easily removed for cleaning by removing screen retainer 93.

A critical element of the present invention is the plurality of ball valves which selectively apply vacuum to the various subcompartments. The unique structure of a ball valve enables it to be interposed in a vacuum line and function unaffected by the wood resin and other contaminates present in a veneer slicer vacuum holding device.

Figure 10:
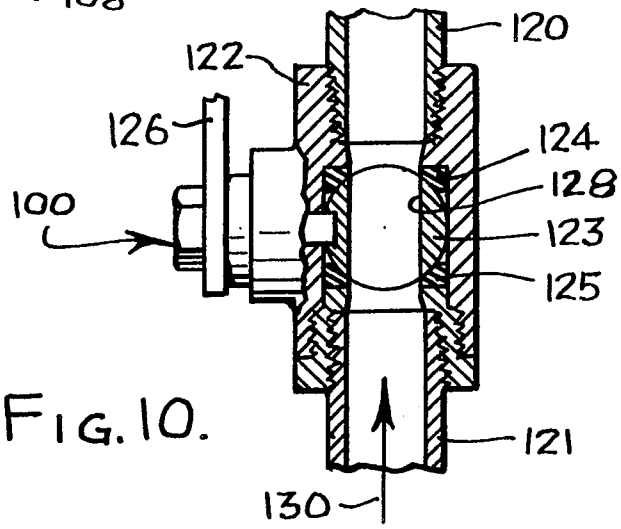
FIG. 10 is a cross-sectional view of a typical ball valve which is an integral part of the present invention.

A typical ball valve is shown in cross-section in FIG. 10. Valve 100 comprises inlet port 121 (threaded pipe), outlet port 120 (threaded pipe), valve housing 122, spherical valve element 123 which contains a throughbore 128 which may be aligned with the inlet and outlet ports, seals 124 and 125, and handle 126 which is connected to the valve element and opens and closes the valve. As shown in FIG. 10, when the valve is open, arrow 130 indicates the direction of an obstructed flow. The spherical surface of the valve element prevents the valve from becoming clogged when opening or closing.

Figures 11, 12:
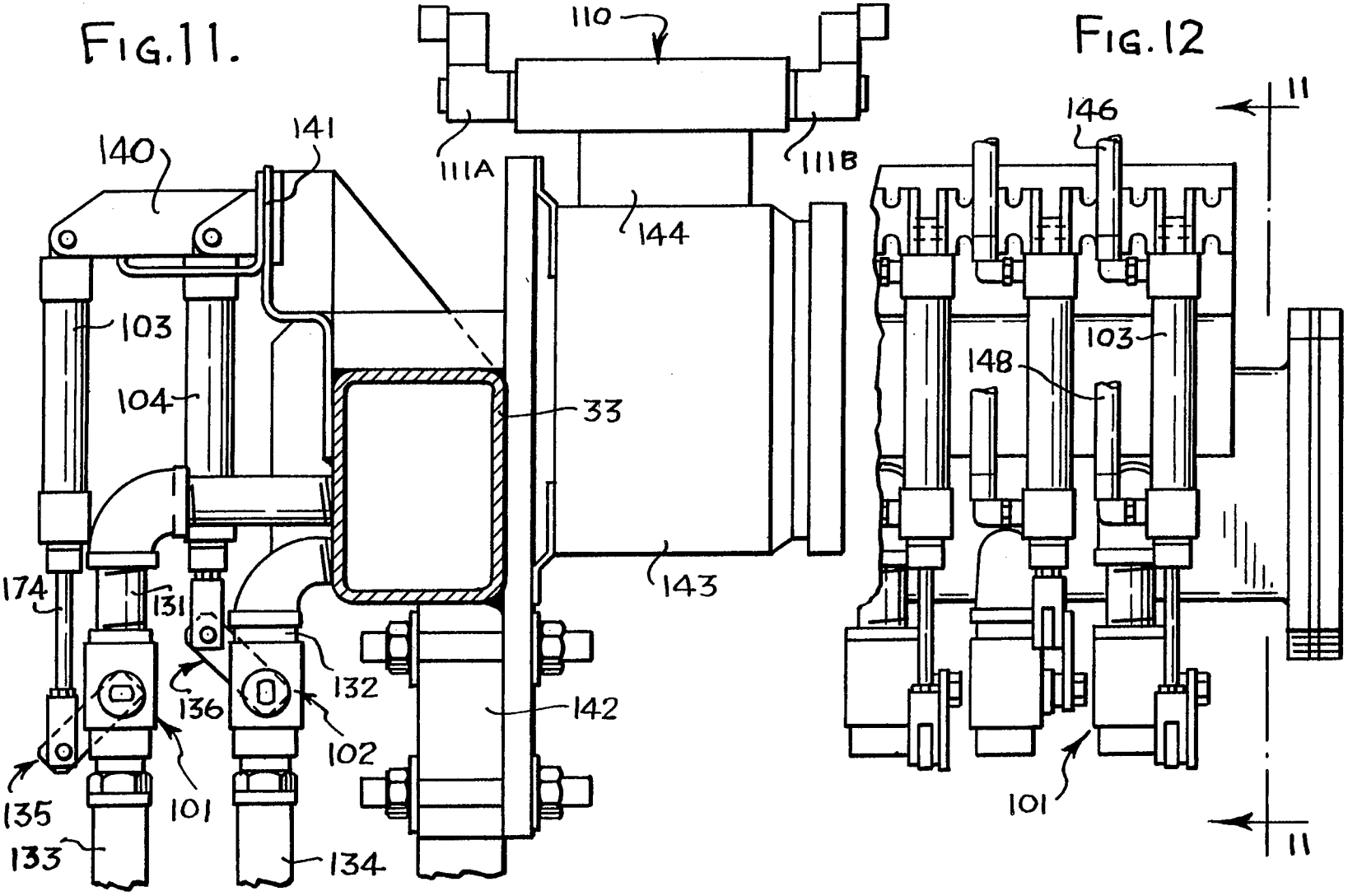
FIG. 11 is a view taken generally along line 11—11 of FIG. 12, illustrating two ball valves, a typical 4-way air valve and its driving solenoids, and showing the vacuum manifold in cross-section.
FIG. 12 is a partial front view illustrating three air cylinders and their associated ball valves.

FIG. 11 illustrates two ball valves 101 and 102. The inlet ports 131 and 132, respectively, of the valves are connected to vacuum manifold 33 which, in turn, is connected to a source of vacuum. The outlet ports 133 and 134 are connected to vacuum subcompartments, not shown. Valves 101 and 102 are controlled by air cylinders 103 and 104, respectively. Valve 103 includes piston 174 which is connected to valve 101 by linkage 135. Cylinder 104 is similarly connected to valve 102 by linkage 136. Valve 101 is shown in an open condition whereas valve 102 is shown in a closed condition.

Air cylinder 103 is mounted to support member 140 which, in turn, is mounted to support member 141. Support member 141 is secured to vacuum manifold 33 and frame member 142.

Also mounted to frame member 142 is electrical junction box 143 which contains the interconnections between the sensors and solenoid lines. Four-way air valve 110, which is controlled by double-acting solenoids 111A and 111B is mounted to manifold sub-base 144. In a preferred embodiment, the air-valve is a Versa 4-way, double solenoid with manual override valve with latch/detent (Model CGG-4222-027-CGL-HC-24VDC available from Versa Products Company, Inc., 22 Spring Valley Road, Paramus, N.J.). The detent feature of the valve enables operation of the ball valve with a momentary electrical signal. During slicing, the photoelectric eye sensors can be de-energized and made inactive. If an eye become momentarily covered inadvertently during slicing, the device will not attempt to create a vacuum in an uncovered compartment. The latching feature also maintains the air cylinders in the correct position (i.e., extended or unextended) during slicing. This is important because the valves are subject to extreme vibration since they are mounted to the flitch table.

FIG. 12 is a partial front view illustrating three air cylinders and their associated ball valves. Air cylinder 103 is shown having inlet port 146 and outlet port 148.

Figure 13:
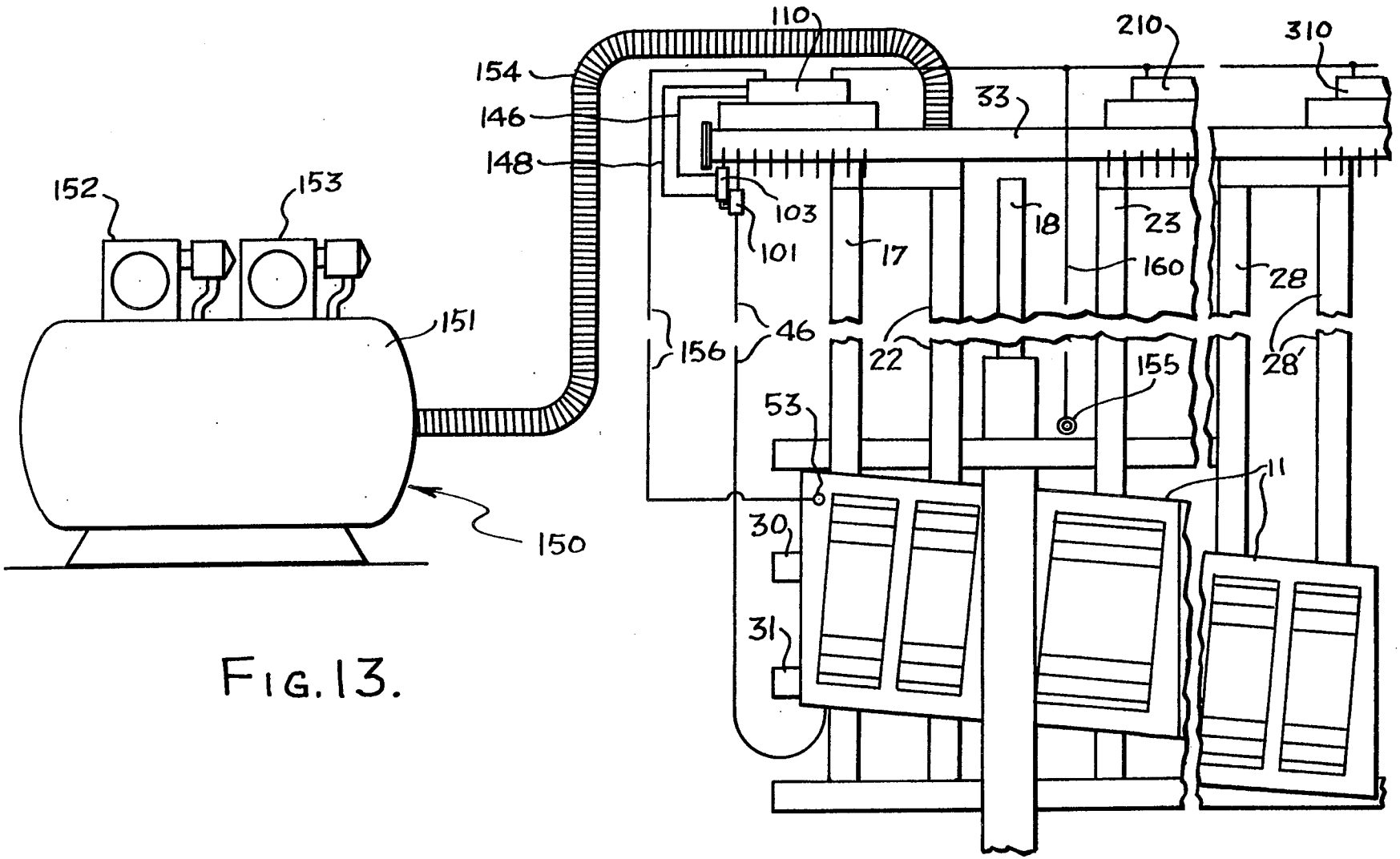
FIG. 13 illustrates the vacuum source and its interconnection to the vacuum manifold and also illustrates schematically some of the air and electrical connections.

FIG. 13 illustrates the vacuum source and its interconnection to the vacuum manifold and also illustrates schematically some of the air and electrical connections. Vacuum source 150 comprises pumps 152 and 153 and tank 151. In a preferred embodiment, an R5 series pump available from Busch, Inc., 516 Viking Drive, Virginia Beach, Va., was used.

The vacuum tank is connected to vacuum manifold 33 via flexible line 154. The manifold provides a source of vacuum to all solenoid/air valve assemblies, of which assemblies 110, 210 and 310 are shown in FIG. 13. Air cylinder control lines 146 and 148 are shown interconnecting valve assembly 110 with air cylinder 103, which controls ball valve 101 which, in turn, provides a vacuum source via port 46 whenever sensor 53 indicates that its subcompartment is covered. Also shown in FIG. 13 is master reset switch 155 which is connected to all valve assemblies and functions to close all ball valves simultaneously to remove the vacuum and release the flitch.

It will thus be seen that the objects set forth above, among those made apparent from the preceding description, are efficiently obtained. Since certain changes may be made in carrying out the above invention and in the constructions set forth without departing from the scope of the invention, it is intended that all matter contained in the above description or shown in the accompanying drawings be interpreted as illustrative and not in a limiting sense. It is also to be understood that the following claims are intended to cover all of the generic and specific features of the invention herein described, and all statements of the scope of the invention, which, might be said to fall therebetween.

What is claimed is:

1. A vacuum holding device for a veneer slicer, comprising:

a vacuum source;

a platen having a flat surface comprising a plurality of vacuum compartments, wherein each compartment contains at least one port connected through a vacuum line to said vacuum source;

sealing means within each compartment, wherein said sealing means surrounds each compartment and also extends outwardly from said compartment beyond said flat surface of said platen such that a flitch to be sliced contacts said sealing means when said flitch is moved proximate said platen, wherein said compartment, sealing means and flitch create a vacuum chamber which holds said flitch in place during slicing; and, a ball valve connected in each vacuum line between each port and said vacuum source, wherein each ball valve is operatively arranged to open to create a vacuum to exist in its respective compartment.

2. A device as recited in claim 1, further including a plurality of spikes fixedly secured to said platen and extending outwardly therefrom, which spikes function to further hold said flitch in place against said platen and prevent movement of said flitch relative to said platen during slicing.

3. A vacuum holding device for a veneer slicer, comprising:

a vacuum source;

a platen having a flat surface comprising a plurality of vacuum compartments, wherein each compartment contains a plurality of subcompartments, and each subcompartment contains at least one port connected through a vacuum line to said vacuum source;

sealing means within each subcompartment, wherein said sealing means surrounds each subcompartment and also extends outwardly from said subcompartment beyond said flat surface of said platen such that a flitch to be sliced contacts said sealing means when said flitch is moved proximate said platen, wherein said subcompartment, sealing means and flitch create a vacuum chamber which holds said flitch in place during slicing; and, a ball valve connected in each vacuum line between each port and said vacuum source, wherein each ball valve is operatively arranged to open to create a vacuum to exist in its respective subcompartment.

4. A device as recited in claim 3, further including a plurality of spikes fixedly secured to the platen and extending outwardly therefrom, which spikes penetrate the flitch when a vacuum is created, functioning to further hold the flitch in place against the platen and prevent movement of the flitch relative to the platen during slicing.

5. A vacuum holding device for a veneer slicer, comprising:

a vacuum source;

a platen having a flat surface comprising a plurality of vacuum compartments, wherein each compartment contains at least one port connected through a vacuum line to said vacuum source;

sealing means within each compartment, wherein said sealing means surrounds each compartment and also extends outwardly from said compartment beyond said flat surface of said platen such that a flitch to be sliced contacts said sealing means when said flitch is moved proximate said platen, wherein said compartment, sealing means and flitch create a vacuum chamber which holds said flitch in place during slicing;

a ball valve connected in each vacuum line between each port and said vacuum source, wherein each ball valve is operatively arranged to open to create a vacuum to exist in its respective compartment; and, means for sensing when said flitch covers a respective compartment; and, means for activating a respective ball valve in a vacuum line connected with said covered compartment, when said sensing means senses that said compartment is covered, to establish a vacuum in said covered compartment.

6. A device as recited in claim 5, further including a plurality of spikes fixedly secured to the platen and extending outwardly therefrom, which spikes penetrate the flitch when a vacuum is created, functioning to further hold the flitch in place against the platen and prevent movement of the flitch relative to the platen during slicing.

7. A device as recited in claim 6 wherein said plurality of compartments are arranged horizontally adjacent one another, and wherein a vacuum is established in only those compartments covered by the flitch, which extends longitudinally across one or more compartments.

8. A device as recited in claim 5 wherein said means for sensing comprises a plurality of photoelectric sensors, where each sensor is mounted within a cavity in said platen, wherein said mounting is offset relative to a compartment being sensed, such that the compartment being sensed must be completely covered by a flitch, and said flitch must overlap said compartment in order to trigger said sensor and establish a vacuum in said covered compartment.

9. A device as recited in claim 5 wherein said means for activation a respective ball valve is a pneumatic cylinder coupled to said valve.

10. A device as recited in claim 9 wherein said cylinder is, in turn, controlled by a four-way air valve driven by a double-acting solenoid, which double-acting solenoid contains two coils and is operatively arranged to remain locked in one position when one solenoid is energized momentarily, and to move to a second locked position when the second coil is momentarily energized.

11. A vacuum holding device for a veneer slicer, comprising:

a vacuum source;

a platen having a flat surface comprising a plurality of vacuum compartments, wherein each compartment contains a plurality of subcompartments, and each subcompartment contains at least one port connected through a vacuum line to said vacuum source;

sealing means within each subcompartment, wherein said sealing means surrounds each subcompartment and also extends outwardly from said subcompartment beyond said flat surface of said platen such that a flitch to be sliced contacts said sealing means when said flitch is moved proximate said platen, wherein said subcompartment, sealing means and flitch create a vacuum chamber which holds said flitch in place during slicing;

a ball valve connected in each vacuum line between each port and said vacuum source, wherein each ball valve is operatively arranged to open to create a vacuum to exist in its respective subcompartment;

means for sensing when said flitch covers a respective subcompartment; and, means for activating a respective ball valve in a vacuum line connected with said covered subcompartment, when said sensing means senses that said subcompartment is covered, to establish a vacuum in said covered subcompartment.

12. A device as recited in claim 11, further including a plurality of spikes fixedly secured to said platen and extending outwardly therefrom, which spikes function to further hold said flitch in place against said platen and prevent movement of said flitch relative to said platen during slicing.

13. A device as recited in claim 12 wherein said plurality of compartments are arranged horizontally adjacent one another, and wherein said plurality of subcompartments are arranged vertically adjacent one another, and wherein a vacuum is established in only those subcompartments covered by the flitch, which extends longitudinally across one or more compartments, and extends widthwise across one or more subcompartments.

14. A device as recited in claim 11 wherein said means for sensing comprises a plurality of photoelectric sensors, where each sensor is mounted within a cavity in said platen, wherein said mounting is offset relative to a subcompartment being sensed, such that the subcompartment being sensed must be completely covered by a flitch, and said flitch must overlap said subcompartment in order to trigger said sensor and establish a vacuum in said covered subcompartment.

15. A device as recited in claim 11 wherein said means for activating a respective ball valve is a pneumatic cylinder coupled to said valve.

16. A device as recited in claim 15 wherein said cylinder is, in turn, controlled by a four-way air valve driven by a double-acting solenoid, which double-acting solenoid contains two coils and is operatively arranged to remain locked in one position when one solenoid is energized momentarily, and to move to a second locked position when the second coil is momentarily energized.

17. A vacuum holding device for a veneer slicer, comprising:

a vacuum source;

a platen having a flat surface comprising a plurality of vacuum compartments, wherein each compartment contains at least one port connected through a vacuum line to said vacuum source;

sealing means within each compartment, wherein said sealing means surrounds each compartment and also extends outwardly from said compartment beyond said flat surface of said platen such that a flitch to be sliced contacts said sealing means when said flitch is moved proximate said platen, wherein said compartment, sealing means and flitch create a vacuum chamber which holds said flitch in place during slicing;

a ball valve connected in each vacuum line between each port and said vacuum source, said ball valve comprising a valve housing, an inlet port and an outlet port, a spherical valve element containing a through-bore, seals, and handle means operatively arranged to move said spherical element into and out of alignment with said inlet and outlet ports, wherein each ball valve is operatively arranged to open to create a vacuum to exist in its respective compartment.

18. A vacuum holding device for a veneer slicer, comprising:

a vacuum source;

a platen having a flat surface comprising a plurality of vacuum compartments, wherein each compartment contains a plurality of subcompartments, and each subcompartment contains at least one port connected through a vacuum line to said vacuum source;

sealing means within each subcompartment, wherein said sealing means surrounds each subcompartment and also extends outwardly from said subcompartment beyond said flat surface of said platen such that a flitch to be sliced contacts said sealing means when said flitch is moved proximate said platen, wherein said subcompartment, sealing means and flitch create a vacuum chamber which holds said flitch in place during slicing;

a ball valve connected in each vacuum line between each port and said vacuum source, said ball valve comprising a valve housing, an inlet port and an outlet port, a spherical valve element containing a through-bore, seals, and handle means operatively arranged to move said spherical element into and out of alignment with said inlet and outlet ports, wherein each ball valve is operatively arranged to open to create a vacuum to exist in its respective compartment.

* * * * *